United States Patent [19]

Delre, Jr.

[11] 4,047,304

[45] Sept. 13, 1977

[54] DRAFTING BOARD WITH ADJUSTABLE STRAIGHT-EDGE ASSEMBLY

[76] Inventor: Anthony Delre, Jr., 7570 Tropicana St., Miramar, Fla. 33023

[21] Appl. No.: 691,387

[22] Filed: June 1, 1976

[51] Int. Cl.[2] ..... B43L 5/00

[52] U.S. Cl. ..... 33/80

[58] Field of Search ..... 33/80

[56] References Cited

U.S. PATENT DOCUMENTS

| | | | |
|---|---|---|---|
| 842,144 | 1/1907 | Gee | 33/80 |
| 2,577,159 | 12/1951 | Seferow | 33/80 |
| 2,701,918 | 2/1955 | Phelps | 33/80 |
| 2,708,328 | 5/1955 | Bryda | 33/80 X |

FOREIGN PATENT DOCUMENTS

| | | | |
|---|---|---|---|
| 52,926 | 10/1911 | Germany | 33/80 |
| 702,594 | 1/1954 | United Kingdom | 33/80 |
| 22,803 | 10/1908 | United Kingdom | 33/80 |

*Primary Examiner*—Charles E. Phillips
*Attorney, Agent, or Firm*—Robert D. Farkas

[57] ABSTRACT

A drafting board includes a pair of laterally spaced base members which are pivotable upon supporting elements. The base members carry a drawing surface which is thus also pivotable. A straight-edge assembly having at least one ruling edge is carried by the drawing surface and is movable therealong between front and rear edges of the drawing surface. The straight-edge assembly has a bracket assembly at each lateral end thereof surmounting the side edges of the drawing surface, and the ruling edge of the assembly extends between the brackets and is pivotably secured to the brackets. The straight-edge assembly is laterally extensible and is movable along the drawing surface in a manner such that one end thereof is movable independently of the other so as to permit angular positioning of the ruling edge relative to the front edge of the drawing surface.

7 Claims, 4 Drawing Figures

DRAFTING BOARD WITH ADJUSTABLE STRAIGHT-EDGE ASSEMBLY

BACKGROUND OF THE INVENTION

The present invention relates to drafting boards and more particularly to a drafting board having a straight-edge assembly with a ruling edge that is movable with respect to a drawing surface such that the ruling edge is positionable at various selected angles relative to the front edge of the drawing surface.

Drafting boards having a movable straight-edge assembly have been known heretofore. Movement is generally effected by means of cooperable gear and track elements. The gear and track elements. The gear elements are usually mounted at the ends of a rigid shaft and are movable as a unit to thereby shift a ruling edge between the front and rear edges of a drawing surface while maintaining the ruling edge in parallel relation to such front edge. A typical prior art drawing board structure of this character is disclosed in U.S. Pat. No. 2,577,159 issued Dec. 4, 1951 to P. Seferow. A prior structure in which some adjustment of the straight-edge assembly is permitted is disclosed in U.S. Pat. No. 2,701,918 issued Feb. 15, 1955 to G. Phelps. However the lateral ends of the straight-edge assemblies of Seferow and Phelps move across the drawing surface essentially as a unit and so as to maintain the ruling edge in parallel relation to the front edge of the drawing surface. There has thus been no capability in prior drafting board structures for the ready and accurate positioning of the ruling edge in a variety of selected angles relative to the front edge of the drawing surface to permit the drawing of lines throughout a wide range of angular settings.

SUMMARY OF THE INVENTION

It is the principal object of the invention to provide a drafting board having a movable straight-edge assembly which enables pivotal movement of the drawing surface into a selected pivoted position and movement of the ruling edge of the straight-edge assembly into any of a plurality of angles relative to the front edge of the drawing surface.

Other objects and advantages of the invention will become readily apparent from the following description of the invention.

According to the present invention there is provided a drafting board comprising in combination: a pair of laterally spaced base members; support means for pivotably mounting the base members; a drawing surface mounted on said base members having front, rear and side edges; a straight-edge assembly, including at least one ruling edge, carried by said drawing surface and extending laterally thereof, said at least one ruling edge being positionable to extend across said drawing surface in any of a plurality of angles relative to the front edge thereof; means on the straight-edge assembly and on the base members cooperable to permit selective movement of the assembly across the drawing surface between the front and rear edges thereof, the means including an extensible multi-segment rotable shaft carried by the assembly and having wheel elements at the opposed ends thereof and track elements carried by the base members adapted to receive the wheel elements and to cooperate therewith for selective movement of the assembly.

BRIEF DESCRIPTION OF THE DRAWINGS

In order that the invention may be more fully understood it will now be described, by way of example, with reference to the accompanying drawings in which.

DETAILED DESCRIPTION OF THE INVENTION

Figure 3:
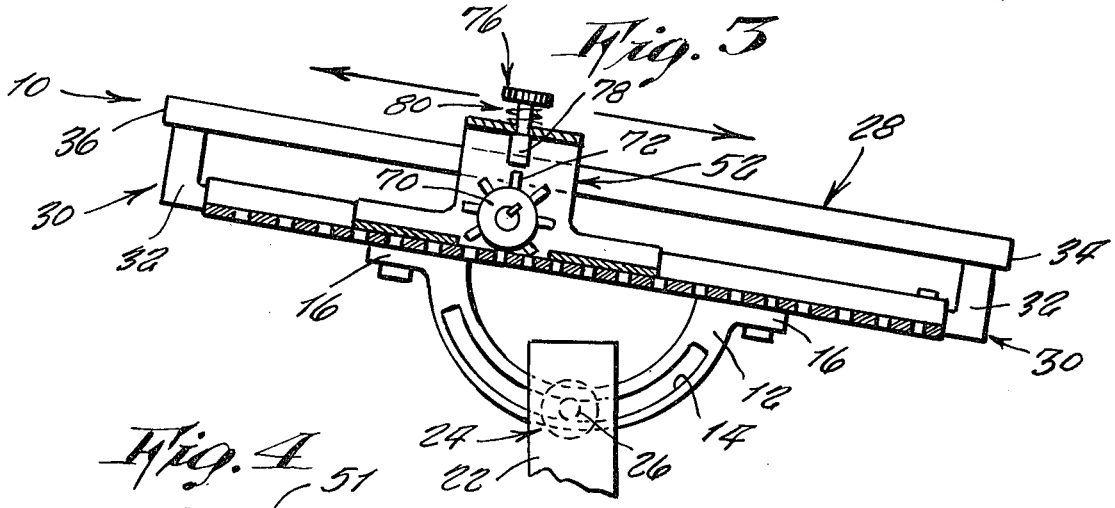
FIG. 3 is a side elevational view of the drafting board shown in FIG. 2, partly in cross-section, taken along line 3—3 thereof.
Figure 4:
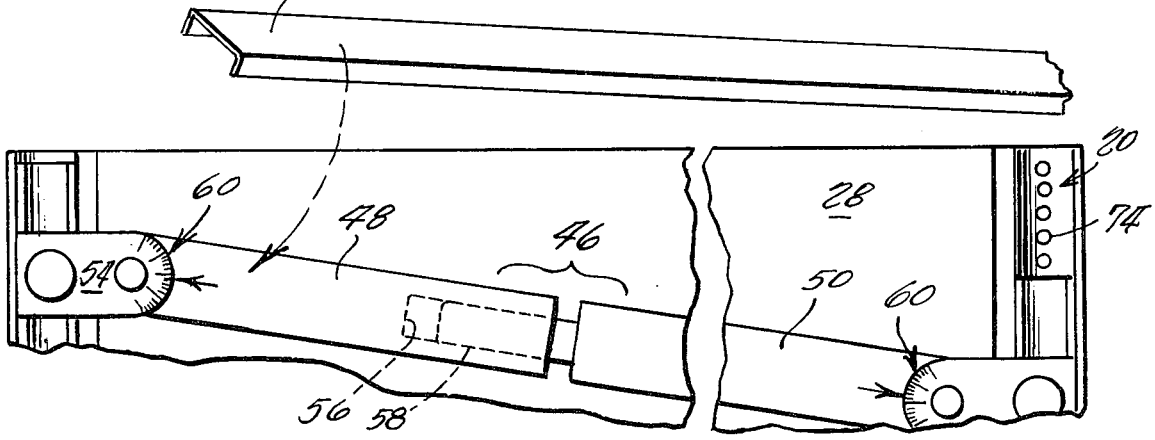
FIG. 4 is a top plan view of the drafting board shown in FIG. 1 with the ruling edge extending diagonally across the drawing surface.

Referring to the drawings there is shown generally, as indicated by reference numeral 10, a drafting board. The drafting board includes a pair of laterally spaced base members 12 which, as shown most clearly in FIG. 3, may be of arcuate form with a slot 14 therein and a pair of flanges 16 by which the flange 18 of a track element 20 may be secured thereto. A support structure 22, partially shown in FIG. 3, supports the base members pivotably thereon. For such purpose a locking mechanism 24 is provided. One convenient form of locking mechanism includes a stud or bolt element 26 carried by support 22 extendable into the slots of the respective base members. In known fashion the bolts clamp the base members to the supports 22 in any selected pvioted position. In this manner a drawing surface 28 to be described hereinafter is pivoted into a desired angle of inclination and is maintained in such position through clamping of the base members to support structure 22.

A drawing surface 28 is mounted on the base members by means of a frame 30 which includes depending and inwardly extending sections 32; however, it will be understood that the specific details for mounting of the drawing surface upon the base members are not critical to the invention, it being merely required that the drawing surface is fixedly secured to the base members for pivotal movement therewith. The drawing surface is desirably formed as a square or rectangular member with a flat top surface or face so as to present front and rear edges 34, 36 and side edges 38, 40.

A straight-edge assembly indicated generally at 42 is carried by the drawing surface. Such assembly includes at least one ruling edge 44 which may be integral with or part of a composite laterally extending member 46. The member is formed in two sections 48, 50 so as to be separable at an intermediate location which desirably is at the mid-point thereof. A shield 51 may be removably positioned over the sections 48, 50 of member 46.

A bracket assembly 52 is provided at each of the opposed lateral ends of the straight-edge assembly and includes a laterally extending flange 54 at one side thereof which overlies the drawing surface 28. The main body of the bracket depends so as to overlie track element 20 mounted on each base member and extending lengthwise of the drafting board. Member 46 has the outer end of each of sections 48, 50 thereof pivotably secured to flange 54 of the corresponding bracket assembly at the opposed sides of the drafting board. The inner end of one of such sections may be given a blind bore 56 dimensioned to slidably receive a shaft or rod element 58 formed at the abutting end of the other section. By such construction the member 46 may extend to occupy a diagonal position across the drawing board upon appropriate movement of the lateral ends of the straight-edge assembly relative to each other. The ruling edge may thus be disposed at any of a wide range of angles relative to the front edge of the drawing surface. The inner extremity of each bracket 52 may be provided with an arcuate calibrated scale or vernier 60 to indicate the angle at which the ruling edge has been disposed.

Figure 1:
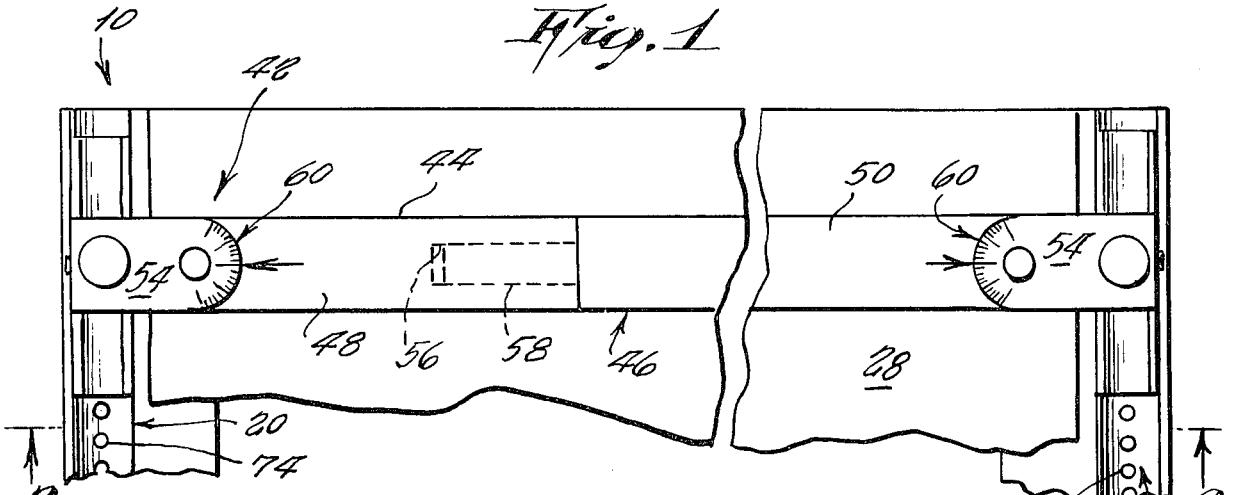
FIG. 1 is a fragmentary top plan view of a drafting board embodying the features of the invention.
Figure 2:
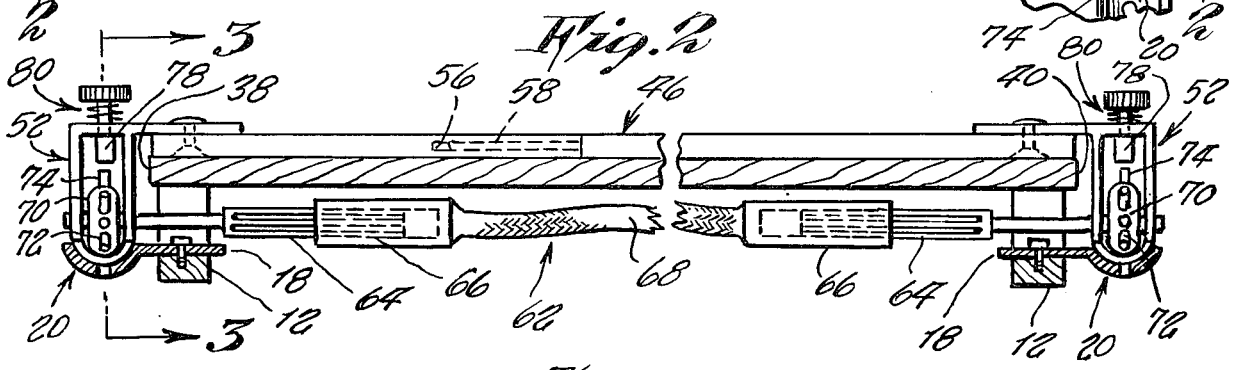
FIG. 2 is a front elevational view of the drafting board shown in FIG. 1, partly in cross-section, taken along line 2—2 thereof.

The straignt-edge assembly includes an eltensible multi-segment shaft 62 which is journaled adjacent its opposite ends in the brackets 52. As can be seen most clearly in FIG. 2 the shaft is provided with at least one pair of cooperable splined segments 64, 66 and with a flexible segment 68 at an intermediate location, desirably at the mid-point of the shaft. A wheel element 70 is carried at each of the opposed ends of the shaft. Desirably the wheel elements are formed of a rubbery material so as to be resilient. Each of such wheel elements is given a plurality of radially extending studs 72. Each of the track elements 20 is given a series of spaced slots 74 therein which are dimensioned to serially receive studs 72 of the respective wheel elements. By this construction each of the lateral ends of the straight-edge assembly is movable along the side of the drawing surface independently of the other so as to enable the angular disposition of member 46 and its ruling edge across the drawing surface relative to the front edge thereof.

A brake mechanism 76 is mounted on each of the brackets 52 and includes a shaft element 78 having a coil spring 80 interposed between an enlarged outer heat 80 of the shaft 78 and flange 54 of the bracket. Thus, shaft 78 is normally biased out of engagement with studs 72 of the wheel element. However, when it is desired to lock the wheel in position against movement in track element 20 the shaft may be pressed against the bias of the spring so as to effectively brake the wheel element. It will be understood, of course, that a friction disc type braking mechanism or other suitable brake devices may be employed.

From the foregoing it will be seen that a drafting board has been provided which is of relatively simple construction. Yet, through the segmented shaft and laterally extensible straight-edge assembly provision has been made for the disposition of the ruling edge at various selected angles relative to the front edge of the drawing surface.

I claim:

1. A drafting board comprising in combination:

a pair of laterally spaced base members;

support means for pivotably mounting said base members;

a drawing surface mounted on said base members having front, rear and side edges;

a straight-edge assembly, including at least one ruling edge, carried by said drawing surface and extending laterally thereof, said at least one ruling edge being positionable to extend across said drawing surface in any of a plurality of angles relative to the front edge thereof;

means on said straight-edge assembly and on said base members cooperable to permit selective movement of said assembly across said drawing surface between the said front and rear edges thereof, said means including an extensible multi-segment rotatable shaft carried by said assembly and having wheel elements at the opposed ends thereof and track elements carried by said base members adapted to receive said wheel elements and to cooperate therewith for selective movement of said assembly.

2. A drafting board according to claim 1, wherein said shaft includes a flexible segment and cooperable splined segments thereby permitting lateral extension of said shaft and independent movement of one lateral end of said assembly relative to the other lateral end and thus the angular disposition of said at least one ruling edge relative to the front edge of said drawing surface.

3. A drafting board according to claim 1, wherein said straight-edge assembly includes a bracket assembly at each lateral end thereof having a lateral flange extending in superposed relation to said drawing surface at one side thereof and extending beyond the respective side edges of said drawing surface and depending in overlying relation to the respective track members, said shaft being supported rotatably by said bracket assemblies.

4. A drafting board according to claim 3, wherein said straight-edge assembly includes first and second ruling edge presenting sections extending laterally across said drawing surface, one end of each of said first and second sections being pivotably carried by one of said bracket assemblies and the other ends of said first and second sections being cooperable to permit endwise movement of said sections relative to each other.

5. A drafting board according to claim 1, wherein each of said base members is provided with a slot and each of said base member support means is provided with locking means slidable in said slots and adapted to lock said base members with the drafting surface thereon in a selected pivoted position.

6. A drafting board according to claim 1, wherein each of said wheel elements comprise a circumferentially extending resilient portion and radially extending stud elements projecting therefrom, each of said track elements having apertures therein adapted to serially receive said stud elements to thereby effect movement of said straight-edge assembly therealong.

7. A drafting board according to claim 6, wherein brake means are provided for locking said straight-edge assembly against movement along said track elements.

* * * * *